United States Patent [19]

Korenko

[11] 4,407,673

[45] Oct. 4, 1983

[54] SOLID SOLUTION STRENGTHENED DUCT AND CLADDING ALLOY D9-B1

[75] Inventor: Michael K. Korenko, Rockville, Md.

[73] Assignee: The United States of America as represented by the U.S. Department of Energy, Washington, D.C.

[21] Appl. No.: 346,340

[22] Filed: Feb. 5, 1982

Related U.S. Application Data

[63] Continuation of Ser. No. 110,525, Jan. 9, 1980, abandoned.

[51] Int. Cl.[3] ..... C22C 38/40

[52] U.S. Cl. ..... 75/128 A; 75/128 Z; 75/128 T; 75/128 W; 148/38

[58] Field of Search ..... 75/128 A, 128 Z, 128 T, 75/128 W; 148/38

[56] References Cited

U.S. PATENT DOCUMENTS

| | | | |
|---|---|---|---|
| 3,764,302 | 10/1973 | Troselius et al. | 75/128 T |
| 4,011,133 | 3/1977 | Bloom et al. | 75/128 T |
| 4,086,085 | 4/1978 | McGurty | 75/128 A |
| 4,234,385 | 11/1980 | Ozaki et al. | 376/457 |

OTHER PUBLICATIONS

Bates et al., *Radiation Effects in Breeder Reactor Structural Materials,* 1977, Met. Soc. AIME, pp. 625–644.

Garner et al., *Proc. of the Workshops on Correlation of Neutron and Charged Particle Damage,* 1976, NTIS, pp. 177–240.

Appleby, *Proc. of the Workshops on Correlation of Neutron and Charged Particle Damage,* 1976, NTIS, pp. 291–312.

Johnston et al., *Proc. of the Workshops on Correlation of Neutron and Charged Particle Damage,* NTIS, pp. 313–347.

Garner et al., *Radiation Effects in Breeder Reactor Structral Materials,* 1977, Met. Soc. AIME, pp. 543–569.

Thomas, ANS Transactions 28, 1978, p. 151.

Brager et al., ANS Transactions 28, 1978, pp. 151–153.

Appleby et al., *Radiation Effects in Breeder Reactor Structural Materials,* 1977, Met. Soc. AIME, pp. 509–527.

Ehrlick et al., *Radiation Effects in Breeder Reactor Structural Materials,* 1977, Met. Soc. AIME, pp. 529–541.

Ellis et al., *Irradiation Effects on Microstructure of Properties of Metals,* ASTM STP6111, 1976, pp. 195–207.

Terasawa et al., *Radiation Effects in Breeder Reactor Structural Materials,* 1977, Met. Soc. AIME, pp. 687–707.

*Primary Examiner*—L. Dewayne Rutledge
*Assistant Examiner*—Debbie Yee
*Attorney, Agent, or Firm*—John J. Prizzi

[57] ABSTRACT

A modified AISI type 316 stainless steel is described for use in an atmosphere where the alloy will be subject to neutron irradiation. The alloy is characterized by its phase stability in both the annealed as well as cold work condition and above all by its superior resistance to radiation induced swelling. Graphical data is included to demonstrate the superior swelling resistance of the alloy which contains from about 0.5% to 2.2% manganese, from about 0.7% to about 1.1% silicon, from about 12.5% to 14% chromium, from about 14.5% to about 16.5% nickel, from about 1.2% to about 1.6% molybdenum, from 0.15% to 0.30% titanium, from 0.02% to 0.08% zirconium, and the balance iron with incidental impurities.

12 Claims, 2 Drawing Figures

SOLID SOLUTION STRENGTHENED DUCT AND CLADDING ALLOY D9-B1

GOVERNMENT CONTRACTS

The invention described herein was made during the course or in the performance of work under U.S. Government Contract No. EY-76-C-14-2170 under the auspices of ERDA.

This is a continuation of application Ser. No. 110,525, filed Jan. 9, 1980 and now abandoned.

BACKGROUND OF THE INVENTION

The present invention is directed to an alloy which finds particular use in a nuclear reactor and is characterized by its improved swelling resistance and phase stability in both the annealed as well as the cold work condition in comparison with an AISI type 316 stainless steel.

With the advent of the nuclear age and the materials problems associated therewith, it was believed that the AISI type 316 stainless steel because of its austenitic character and which is strengthened through a solid solution strengthening addition would prove to be ideally suited for use in a nuclear reactor. This conclusion was buttressed by the fact that the AISI type 316 stainless steel appeared to possess the desired strength characteristics at elevated temperatures. It was soon found however that even after low fluid reactor irradiation copious amounts of radiation induced precipitation were evident in the microstructure and the material was subjected to relatively high swelling. It therefore became apparent that it was necessary to alter the chemical composition AISI type 316 stainless steel in an attempt to eliminate the phase instabilities and to provide improved swelling resistance without seriously adversely affecting the strength characteristics of the fundamental alloy. To this end the alloy of the present invention appears to fulfill these primary requisites.

SUMMARY OF THE INVENTION

The present invention resides in the fact that the desirable properties can be achieved by lowering the relative amounts of nickel, chromium, and molybdenum while still maintaining the austenitic characteristic of the alloy when the same is subjected to elevated temperature irradiation of the type normally found for example as fuel pins in a nuclear reactor. More specifically, the alloy will exhibit improved swelling resistance at elevated temperatures in both the annealed as well as the cold work condition. Accordingly, these objectives as well as other objects can be obtained in the alloy of the present invention and are more specifically set forth in the attached specification and the drawings in which FIG. 1 is a plot of percent swelling verses the temperature of the alloy of the present invention in comparison with standard AISI type 316 stainless steel. It being noted that the actual numbers of the data points are the actual fluence values and FIG. 2 is similar to FIG. 1 but with the material in the cold work condition. It being noted that the AISI type 316 stainless steel has been cold worked 20% whereas the alloy of the present invention has been cold work 25%.

DESCRIPTION OF THE PREFERRED EMBODIMENTS

Table 1 set forth hereinafter lists the chemical composition of the AISI type 316 stainless steel as well as the broad range, the preferred range, and the specific composition of a heat falling within the preferred as well as the broad ranges as set forth herein.

TABLE I

| Element | Commercial AISI 316 (Standard RDT Me-28T) | Broad Range | Preferred Range | H + # 5976 |
|---|---|---|---|---|
| C | .04–.06 | .02–0.1 | 0.03–0.40 | 0.039 |
| Mn | 1.5–2.0 | 1.5–2.5 | 1.8–2.5 | 1.99 |
| Si | 0.5–0.75 | 0.5–1.1 | 0.9–1.1 | .98 |
| P | 0.02* | | | .005 |
| S | 0.01* | | | .005 |
| Cr | 17.0–18.0 | 12–14 | 13.25–13.75 | 13.45 |
| Ni | 13.0–14.0 | 14–16 | 15.25–15.75 | 15.45 |
| Mo | 2.0–3.0 | 1.2–1.7 | 1.4–1.6 | 1.44 |
| Al | 0.05* | 0.01* | 0.01* | .01 |
| B | 0.0010* | | | .001 |
| Ti | | .2–.5 | .20–.30 | .17 |
| Zr | | 0.1* | .04–.06 | .029 |
| Nb | 0.050* | | | .01 |
| Fe | Bal. | Bal. | Bal. | Bal. |

*Maximum

Figure 1:
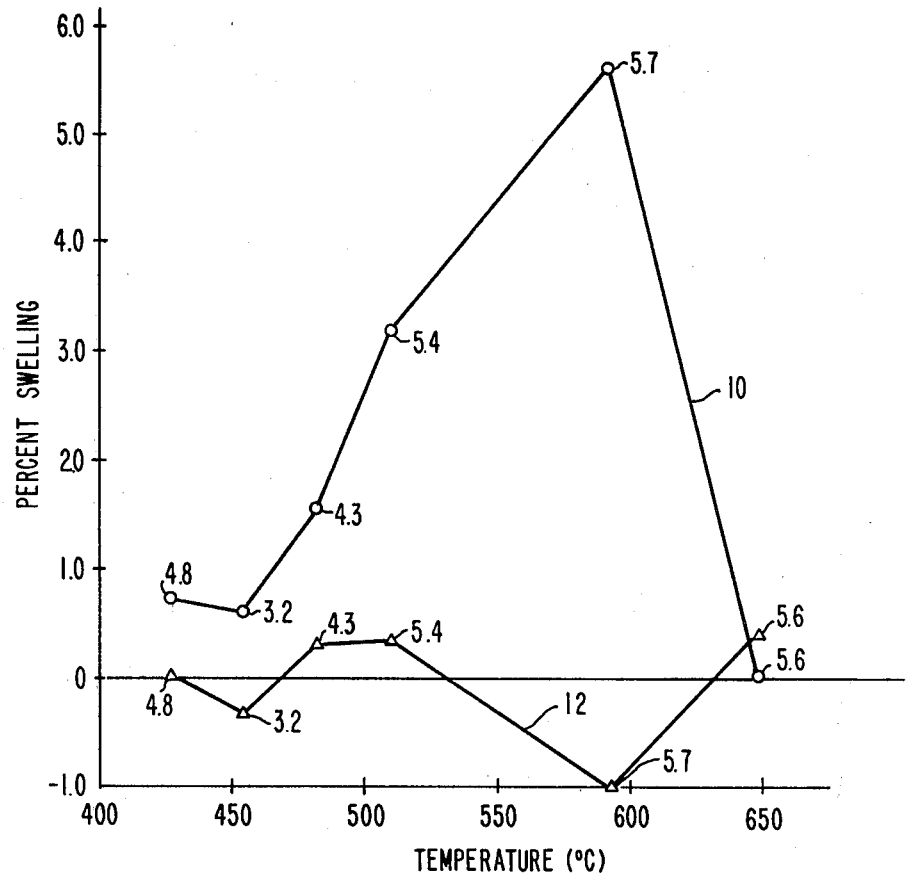
Figure 2:
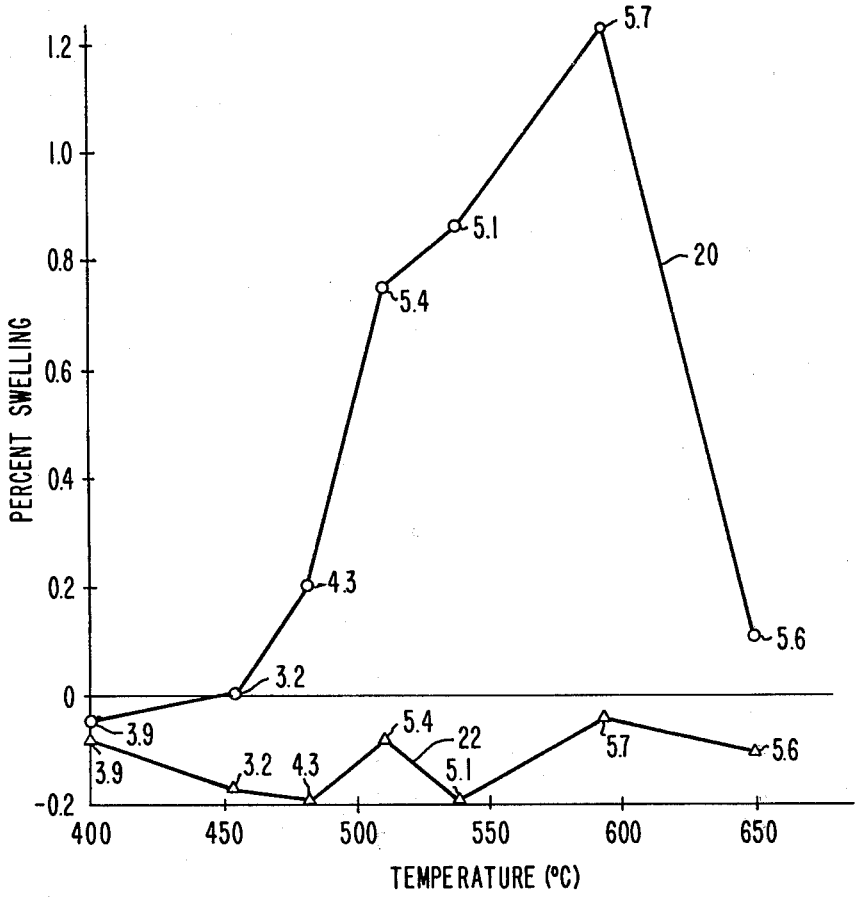

By inspection of Table 1 it becomes clear that the alloy of the present invention has less chromium, more nickel, and less molybdenum than that of a corresponding AISI type 316 stainless steel. Moreover, as can be seen from Table 1 the large reduction of the chromium together with a smaller reduction of the molybdenum and an increase in the nickel is effective for maintaining the austenitic character of this alloy which austenitic character is strengthened by means of the molybdenum addition thereto. Note in particular that since the titanium and zirconium contents are quite limited, the microstructure of the alloy remains substantially precipitation free after extended exposures to the influence of neutron irradiation at elevated temperatures. In order to more clearly and graphically depict the improvement in swelling resistance exhibited by the alloy of the present invention, attention is directed to FIG. 1 which directly compares a solution annealed AISI type 316 stainless steel and the alloy of this invention having the composition of heat number 5976 as identified in Table 1 and the effect of the temperature at various fluence values in relation to the percent swelling. Curve 10 of FIG. 1 is a plot of the AISI type 316 stainless steel material whereas curve 12 is a plot of the identical values exhibited by the alloy of the present invention in the solution annealed condition which alloy has been arbitrarily designated D9B1. As can be seen from the data set forth in FIG. 1, the alloy of the present invention has far superior swelling resistance to that exhibited by the AISI type 316 stainless steel. This is especially so when the percent swelling is considered at about the temperature of 600° C. and that a fluence value of $5.7\times10^{22}$ neutrons per square centimeter. These same results are more outstanding when the data is compared for the material in the cold work condition. Thus in FIG. 2, the curve 20 illustrates the data for AISI type 316 stainless steel in the 20% cold work condition and curve 22 shows the swelling resistance of alloy D9B1 in the 25% cold work condition. It is also believed significant to point out that in the cold work condition, the alloy of the present invention is still densifying while the AISI type 316 stainless steel is into the void swelling regiment regardless of the temperatures employed. Thus, these data make it clear that the alloys of the present invention are particularly suitable for use for example in a fast breeder reactor. It has been found however that the long term stress rupture properties at temperatures greater than 650° C. appear to be weaker than AISI type 316 stainless steel based on the latest unradiated specimen testing. However, it is believed that comparable results can be obtained where the material is in the cold worked condition and the degree of cold working is limited to about 20% for optimum stress rupture and swelling resistance characteristics. While it will be appreciated that the swelling resistance characteristics will still be outstanding where the alloy is worked to a degree greater than 20%. The optimum results appear to be obtained when the cold working is limited to 20%. For swelling resistance alone, it has been found that cold working the material within the range between about 15% and 40% does not appear to adversely affect the swelling resistance demonstrated by the alloy of the present invention.

We claim:

1. An austenitic iron base alloy characterized by improved microstructural stability and swelling resistance superior to AISI type 316 stainless steel in a neutron irradiation atmosphere, said alloy consisting essentially of from about 14% to about 16% nickel, from about 12% to about 14% chromium, from about 1.2% to about 1.7% molybdenum, from about 0.5% to about 1.1% silicon, from about 1.5% to about 2.5% manganese, up to 0.1% zirconium, from about 0.2% to about 0.5% titanium, from about 0.02% to about 0.1% carbon, up to 0.01% boron and the balance iron with incidental impurities.

2. An austenitic iron base alloy characterized by improved microstructural stability and swelling resistance superior to AISI type 316 stainless steel in a neutron irradiation atmosphere, said alloy consisting essentially of from about 15.25% to about 15.75% nickel, from about 13.25% to about 13.75% chromium, from about 1.4% to about 1.6% molybdenum, from about 0.9% to about 1.1% silicon, from about 1.8% to about 2.5% manganese, from about 0.04% to about 0.06% zirconium, from about 0.2% to about 0.3% titanium, from about 0.03% to about 0.04% carbon, up to 0.01% boron and the balance iron with incidental impurities.

3. The alloy according to claim 1 further characterized by being in a cold worked condition.

4. The alloy according to claim 2 further characterized by being in a cold worked condition.

5. The alloy according to claim 3 wherein said alloy is in a 15 to 40% cold worked condition.

6. The alloy according to claim 4 wherein said alloy is in a 15 to 40% cold worked condition.

7. The alloy according to claim 3 wherein after equivalent exposures in said neutron irradiation atmosphere said alloy is further characterized by continuing in a densifying mode after said AISI 316 stainless steel has entered into a void swelling regime; and wherein said AISI 316 stainless steel is in a cold worked condition.

8. The alloy according to claim 4 wherein after equivalent exposures in said neutron irradiation atmosphere said alloy is further characterized by continuing in a densifying mode after said AISI 316 stainless steel has entered into a void swelling regime; and wherein said AISI 316 stainless steel is in a cold worked condition.

9. The alloy according to claim 1 wherein said neutron irradiation atmosphere is a fast breeder reactor.

10. The alloy according to claim 8 wherein said neutron irradiation atmosphere is a fast breeder reactor.

11. The alloy according to claim 1 further characterized by being in an about 20% cold worked condition.

12. The alloy according to claim 2 further characterized by being in an about 20% cold worked condition.

* * * * *

UNITED STATES PATENT AND TRADEMARK OFFICE

CERTIFICATE OF CORRECTION

PATENT NO. : 4,407,673

DATED : October 4, 1983

INVENTOR(S) : Michael K. Korenko

It is certified that error appears in the above—identified patent and that said Letters Patent is hereby corrected as shown below:

Column 2, line 14, cancel both occurrences of "0.01*".

Column 2, line 15, insert under both the "Broad Range" heading and the "Preferred Range" heading -- 0.01* --.

Signed and Sealed this

*Twenty-eighth* Day of *January 1986*

[SEAL]

*Attest:*

DONALD J. QUIGG

*Attesting Officer*

*Commissioner of Patents and Trademarks*